US007001255B2

(12) United States Patent
Ploeger et al.

(10) Patent No.: US 7,001,255 B2
(45) Date of Patent: Feb. 21, 2006

(54) THERMOSTAT GASKET CLEANER

(75) Inventors: Randall J. Ploeger, Clarinda, IA (US); Alexander Serrano, Prairie View, IL (US); Louis Salamone, Glendale, AZ (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 10/823,296

(22) Filed: Apr. 13, 2004

(65) Prior Publication Data

US 2005/0227598 A1 Oct. 13, 2005

(51) Int. Cl.
*B24B 1/00* (2006.01)

(52) U.S. Cl. ..... 451/115; 451/358; 451/359; 451/345; 81/177.2; 29/255

(58) Field of Classification Search ..... 451/358, 451/359, 115, 292, 26, 345, 346; 81/177.2, 81/491, 53.1, 125, 124.5, 177.1; 29/255, 29/263

See application file for complete search history.

(56) References Cited

U.S. PATENT DOCUMENTS 1,749,709 A * 3/1930 Loveland ..... 451/511
2,993,397 A * 7/1961 Albertson et al. ..... 81/125
5,471,899 A * 12/1995 Twomlow ..... 81/60
5,836,223 A * 11/1998 Lin ..... 81/436
6,814,656 B1 * 11/2004 Rodriguez ..... 451/359
2004/0173059 A1 * 9/2004 Klein et al. ..... 81/177.2

OTHER PUBLICATIONS

*Merit Abrasive Products Inc.*, Power-Lock Disc Alo Resin Bond, p. 24.
*Merit Abrasive Products Inc.*, Flex-Edge Alo Resin Bond Discs, and Quick Change Holders, p. 28.
Idea Disclosure—Feb. 5, 2001, Alexander Serrano.
Idea Disclosure—Nov. 27, 2001, Arthur R. Long.
Idea Disclosure—Mar. 12, 2002, Mike (Miqual) Santos A.
Idea Disclosure—Dec. 24, 2002, Louis Salamone.
Idea Disclosure—Feb. 1, 2003, Nikol Satenstein.

* cited by examiner

*Primary Examiner*—George Nguyen
(74) *Attorney, Agent, or Firm*—Banner & Witcoff, Ltd.

(57) ABSTRACT

A gasket removal and cleaning tool includes a drive rod rotatably retained within a sleeve enabling the rod to be driven by a die grinder. The opposite end of the drive rod projects from the sleeve and includes an abrasive element that may be used to remove a seal from a sealing surface and to polish or clean the surface.

2 Claims, 2 Drawing Sheets

FIG.2
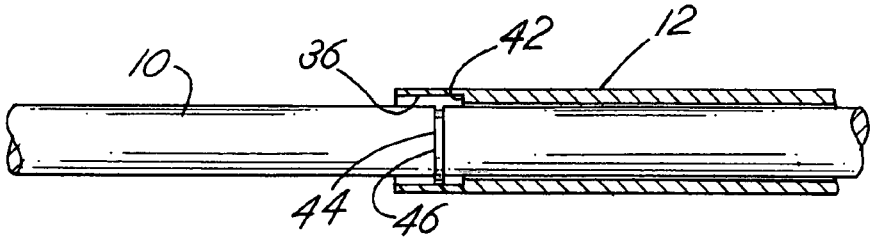
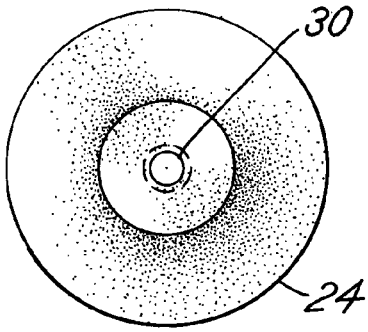
FIG.4
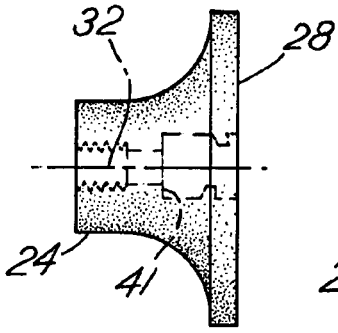
FIG.3
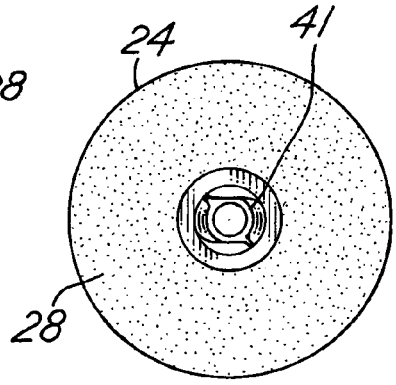
FIG.5
FIG.8
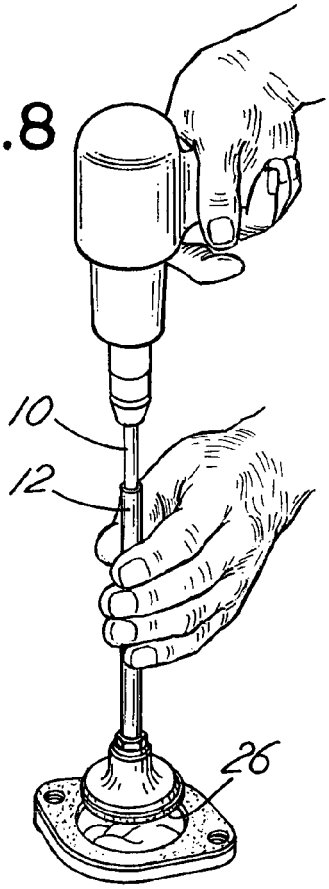
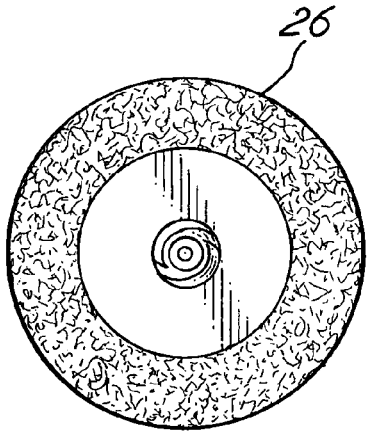
FIG.7
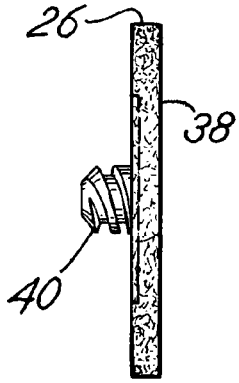
FIG.6

THERMOSTAT GASKET CLEANER

BACKGROUND OF THE INVENTION

In a principal aspect the present invention relates to an automotive repair tool, and more particularly, to a device or tool which may be used in combination with a die grinder to remove a gasket from a sealing surface and to clean that surface. In particular, the tool is designed for use with respect to the thermostat gasket seal of a motor vehicle, but has other applications.

Motor vehicles typically include a thermostatic device which is incorporated in the engine compartment as part of the cooling system in a manner which enables the thermostat to be appropriately positioned in the fluid flow line associated with the engine cooling system. From time to time it is necessary to repair and/or replace the thermostat device associated with the engine cooling system. Replacement of the thermostat device is typically effected by merely unscrewing or otherwise removing the thermostatic device. However, generally such a device is positioned on a seal which engages a sealing surface so that there will be no leakage around the thermostat device as it is positioned in association with the engine cooling system. Removal of that gasket, which often is partially corroded or disintegrated, becomes a challenging issue. Using the end of a screwdriver or some type of scraping tool is often ineffective to properly clean the sealing surface. Thus, there has developed a need to provide a cost effective manner or mechanism by which the gasket sealing surface associated with a thermostat of an engine cooling system can be easily and assuredly cleaned so that a new gasket may be positioned thereon and a new thermostat device placed in communication with the cooling system.

SUMMARY OF THE INVENTION

Briefly, the present invention comprises a gasket removal and cleaning tool which incorporates an elongate rod which may be rotationally driven so as to rotate an abrasive disk at one end of the rod. The rod is positioned and retained rotatably within a hollow sleeve which may be manually gripped to properly position the abrasive disk as the tool is being used. A retention mechanism enables rotation of the elongate drive rod while maintaining the hollow sleeve in a fixed non-rotatable position relative to the rotating rod.

Thus, it is an object of the invention to provide an improved gasket removal and cleaning tool.

It is a further object of the invention to provide an improved gasket removal and cleaning tool which is easy to use and may be positioned in places that are somewhat difficult to access.

Another object of the invention is to provide a gasket removal and cleaning tool which is rugged, inexpensive and easy to use.

Another object of the invention is to provide a gasket removal and cleaning tool for use particularly in combination with or for removal of engine cooling thermostat gaskets but which may be used in other situations for gasket removal and cleaning of sealing surfaces.

These and other objects and advantages will be set forth in the detailed description which follows.

BRIEF DESCRIPTION OF THE DRAWING

In the detailed description which follows, reference will be made to the drawing comprised of the following figures:

FIG. 2 is an exploded sectional view of the mechanism of the tool which retains the shield or sleeve over the rotatable rod of the tool;

FIG. 3 is a side elevation of the block holder or abrasive element holder positioned at one end of the tool;

FIG. 4 is a right hand end view of the element of FIG. 3;

FIG. 5 is a left hand side elevation of the element of FIG. 3;

FIG. 6 is a side elevation of an abrasive disk utilized in combination with the holder of FIG. 3;

FIG. 7 is a top plan view of the disk of FIG. 6; and

FIG. 8 is an isometric view illustrating the manner of use of the tool of FIG. 1.

DESCRIPTION OF THE PREFERRED EMBODIMENT

Figure 1:
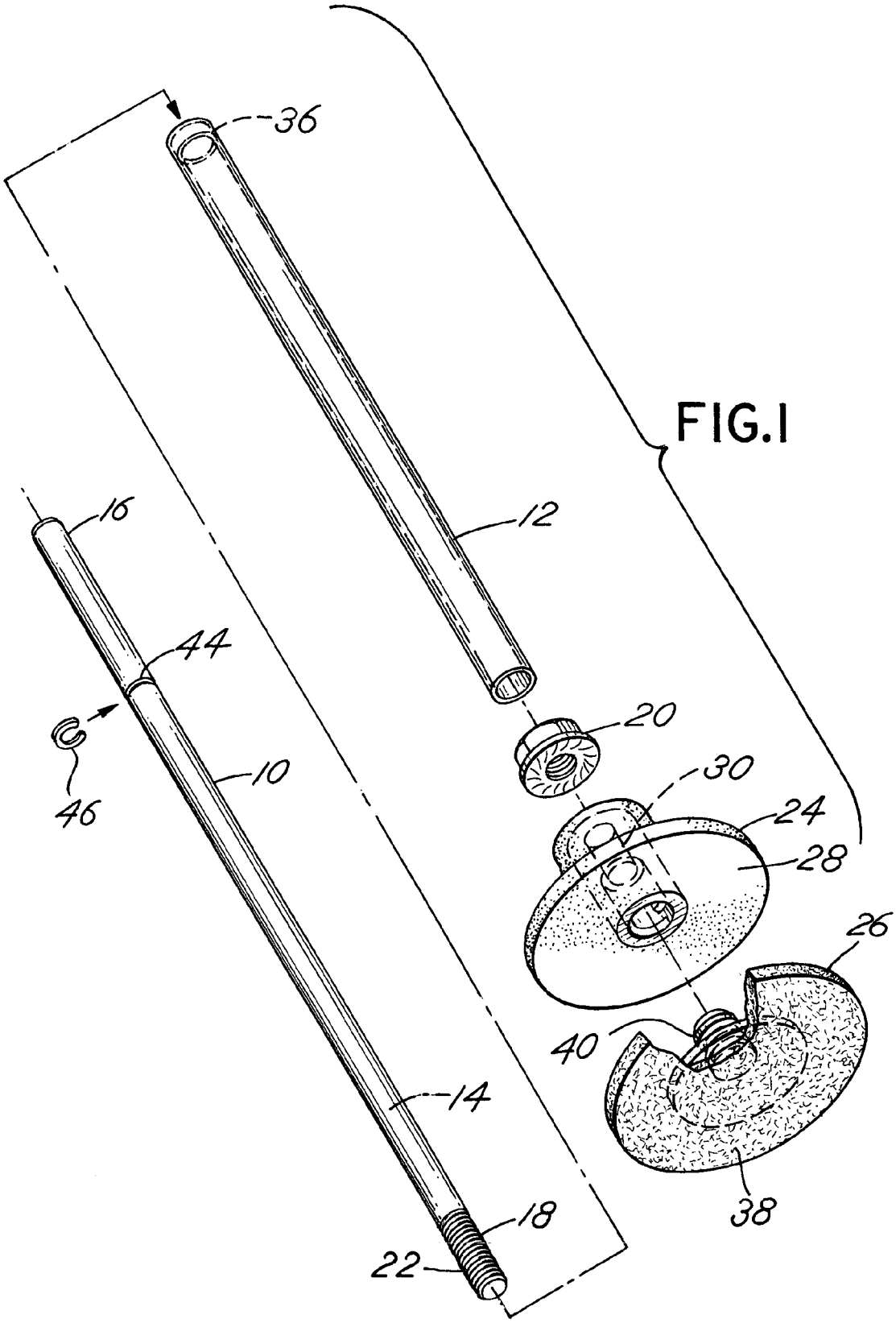
FIG. 1 is an exploded isometric view of the gasket removal and cleaning tool of the invention.

Referring to the figures, the gasket removal and cleaning tool of the invention includes a cylindrical drive shaft or rod 10 which is rotatably positioned and mounted within a sleeve or shield 12 in the form of a cylindrical tube. The drive rod 10 is elongate relative to the tube 12. The rod 10 and tube 12, however, define a longitudinal rotational axis 14 inasmuch as the rod 10 is rotatable within the tube 12.

The rod 10 includes a drive end 16 and an abrasive disk attachment end 18. A lock nut 20 is affixed at the abrasive attachment end 18 in a manner which enables exposure of threads 22 at the abrasive attachment end 18. A roll lock holder element 24 is threadably attached to the abrasive attachment end 18 and is constructed to retain a replaceable abrasive disk 26 thereon. Thus, the holder element 24 includes a generally flat planar support surface 28 and a threaded passage 30. The holder element 24 is threaded onto the threaded end 18 by engaging threads 22. The threaded passage 30 of the holder element 24 includes a center line longitudinal axis 32 which is aligned with the axis 14 in the rod 10 and tube 12.

The abrasive disk 26 depicted in FIGS. 6 and 7 comprises an abrasive outer surface 38 and a mounting hub 40. The mounting hub 40 coacts with and enables connection thereof to a counterbore 41 in the holder element 24. Attachment may be effected by means of a thread form on the hub 40 with a compatible thread form in counterbore 41. Typical abrasive disks that are considered useful in the combination comprising the tool include a disk product made by Merit Abrasive Products, Part No. 62914 which is identified as "OC Disk 2" Dia. Surfprep Type III Type C" having a grit designation of VF. The abrasive disk is approximately 2 inches in diameter thereby having a size which enables utilization thereof in removal of a thermostat gasket and in cleaning the surface of the seal associated with a thermostatic gasket. Disks having other diameters may be used also.

An important feature of the invention is illustrated in FIG. 2 wherein the shield or tube 12 is depicted in combination with the elongate shaft or rod 10. FIG. 2 depicts the manner in which the shield or sleeve 12 is retained on the rod 10. That is, the shield or rod 12 includes an outer end counterbore section 36 defining an internal land 42. The rod 10 includes a circumferential slot 44 which is designed to receive an external C-clip 46. The C-clip 46 is sized to fit into slot 44 and engage against the land 42 whereby preventing longitudinal movement and removal of the sleeve or tube 12 from the rod 10 by movement to the left as depicted in FIG. 2. The sleeve 12 is retained in position and prevented from excess movement to the right as depicted in FIG. 1 by the lock nut 20. In this manner, the shield or tube 12 is permitted a certain minimal amount of longitudinal movement relative to the rod 10 but is otherwise retained on the rod 10. This becomes important in order to control the position of the tool relative to the surface which is being abraded or cleaned by the tool as depicted, for example, in FIG. 8. Other types of retainer mechanisms may be utilized which limit longitudinal movement, but do not inhibit rotation of rod 10.

Referring to FIG. 8, it will be noted that the tool is used in the following manner. First, the outer or drive end of the rod; namely, the end 16, may be inserted in a rotational drive tool, such as an air die grinder. Retained within the chuck of a die grinder, the rod 10 may then be rotated by operation of the grinder. The mechanic or tradesman utilizing the tool may then grasp the sleeve or tube 12 and position or direct the abrasive end or disk 26 of the tool on a surface in order to clean that surface and polish the surface using the abrasive material. The rod 10, of course, may be rotated while the sleeve 12 is held in a fixed position by the mechanic or tradesman. In this manner, the tool becomes an effective means for removing the gasket which may be corroded and in cleaning the surface associated with the gasket which also may be corroded.

The length of the rod 10 and the sleeve 12 as well as the diameter of the holder 24 and associated abrasive element 38 may be varied. The type of abrasive material may also be varied. Thus, the invention is to be limited only by the following claims and equivalents.

What is claimed is:

1. A gasket removal and cleaning tool comprising, in combination:

an elongate rod having a rotational drive end and an active abrasive attachment end;

an abrasive disk attached to the abrasive attachment end;

a hollow sleeve having a first end and a second end, said sleeve mounted on the elongate rod, said hollow sleeve extending longitudinally for a portion along the length of the rod, said rod freely rotational in the sleeve with said disk attachment end of said rod extending from said first end and the drive end of the rod extending from the second end; and a retention mechanism for maintaining the sleeve on the rod with the drive end of the rod accessible to rotationally drive the rod and attached disk, said retention mechanism including a counterbore at one of said ends of said sleeve, and a retainer flange on the rod locatable in the counterbore to limit longitudinal movement of the sleeve and to shield the flange.

2. The tool of claim 1 wherein the rod defines a longitudinal axis, and the disk comprises an abrasive pad normal to the axis.

* * * * *